US007159964B2

(12) United States Patent
Funk et al.

(10) Patent No.: US 7,159,964 B2
(45) Date of Patent: Jan. 9, 2007

(54) INKJET PRINTER SPIT CUP ASSEMBLY

(75) Inventors: John N. Funk, Lexington, KY (US); Terry L. King, Versailles, KY (US); Bryan C. Scharf, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 338 days.

(21) Appl. No.: 10/956,924

(22) Filed: Sep. 30, 2004

(65) Prior Publication Data

US 2006/0066666 A1 Mar. 30, 2006

(51) Int. Cl.
*B41J 2/165* (2006.01)

(52) U.S. Cl. ..... 347/36; 347/29; 347/32; 347/33; 347/35

(58) Field of Classification Search ..... 347/36, 347/29, 32, 33, 35
See application file for complete search history.

(56) References Cited

U.S. PATENT DOCUMENTS 4,701,771 A 10/1987 Ikeda
5,097,276 A 3/1992 Midorikawa
5,103,244 A 4/1992 Gast et al.
5,146,243 A 9/1992 English et al.
5,617,124 A 4/1997 Taylor et al.
5,946,009 A 8/1999 Youn
6,247,783 B1 6/2001 Shibata et al.
6,273,547 B1 * 8/2001 Aldrich ..... 347/36
6,340,220 B1 1/2002 Gaylor et al.
6,644,779 B1 11/2003 Aldrich et al.
7,097,276 B1 * 8/2006 Itoh ..... 347/35

* cited by examiner

*Primary Examiner*—Shih-Wen Hsieh
(74) *Attorney, Agent, or Firm*—Douglas E. Erickson

(57) ABSTRACT

A first inkjet printer spit cup assembly includes a spit cup having a mounting hole and inner teeth, includes a cylindrical post attached to a base portion and positioned in the mounting hole, and includes a wing. The wing and inner teeth are adapted to permit rotation, and to prevent counter-rotation, of the spit cup about the cylindrical post. A second inkjet printer spit cup assembly includes a spit cup having a mounting hole and bottom teeth, includes a cylindrical post attached to a base portion and positioned in the mounting hole, and includes a top tooth extending from the base portion. The top tooth and bottom teeth are adapted to permit rotation, and to prevent counter-rotation, of the spit cup about the cylindrical post.

42 Claims, 8 Drawing Sheets

INKJET PRINTER SPIT CUP ASSEMBLY

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to inkjet printers, and more particularly to an inkjet printer spit cup assembly.

2. Description of the Related Art

Known inkjet printers include those having an inkjet printer head attached to a movable printhead carrier which enters a maintenance area (outside the printable area of a sheet of paper) to energetically fire (spit) ink drops from the ink jet nozzles of the inkjet printer head to clean the ink jet nozzles of any clogged ink. Such ink drops are collected in a horizontally-oriented spit cup as described in U.S. Pat. No. 6,644,779. The spit cup has a central hole allowing it to be placed over a vertical boss (post) molded into part of the printer base. The spit cup rotates in one direction about the boss as ratchet teeth on the outer circumference of the spit cup are engaged by a projection on a maintenance sled pushed by the moving carriage. A back-stop spring biases the spit cup toward the projection on the maintenance sled. The back-stop spring prevents counter-rotation of the spit cup as the maintenance sled returns to its starting position when the printhead carrier moves back out of the maintenance area. The back-stop spring represents additional material and assembly cost. Still, scientists and engineers continue to seek improved inkjet printer spit cup assemblies.

SUMMARY OF THE INVENTION

A first expression of a first embodiment of the invention is for an inkjet printer spit cup assembly including an inkjet printer spit cup, an inkjet printer base portion, a cylindrical post, and a wing. The inkjet printer spit cup has an inner wall surface which surrounds a mounting hole and which includes inner teeth. The cylindrical post: has a longitudinal axis; is attached to, and extends substantially vertically from, the base portion; and is positioned in the mounting hole. The wing is attached to at least one of the base portion and the cylindrical post, and the wing is located between two adjacent inner teeth. The wing and the inner teeth are adapted to permit rotation of the spit cup about the cylindrical post and to prevent counter-rotation of the spit cup about the cylindrical post.

A second expression of a first embodiment of the invention is for an inkjet printer spit cup assembly including an inkjet printer spit cup, an inkjet printer base portion, a cylindrical post, and a wing. The inkjet printer spit cup has an inner wall surface which surrounds a mounting hole and which includes inner teeth. The cylindrical post: has a longitudinal axis; is attached to, and extends substantially vertically from, the base portion; and is positioned in the mounting hole. The wing is attached to at least one of the base portion and the cylindrical post, is located between two adjacent inner teeth, and biases the spit cup to a position which is non-coaxial with the cylindrical post. The wing and the inner teeth are adapted to permit rotation of the spit cup about the cylindrical post and to prevent counter-rotation of the spit cup about the cylindrical post.

A third expression of a first embodiment of the invention is for an inkjet printer spit cup assembly including an inkjet printer spit cup, an inkjet printer base portion, a cylindrical post, and a wing. The inkjet printer spit cup has an inner wall surface which surrounds a mounting hole and which includes inner teeth. The cylindrical post: has a longitudinal axis; is attached to, and extends substantially vertically from, the base portion; and is positioned in the mounting hole. The wing has a shape of substantially a one-quarter cone having a substantially conical surface and a substantially flat surface. The wing is attached to the base portion and the cylindrical post and is located between two adjacent inner teeth. The substantially conical surface of the wing is in supporting contact with at least one of the two adjacent inner teeth of the inner wall surface biasing the spit cup to a position which is non-coaxial with the cylindrical post. Each inner tooth includes a leading surface and a substantially flat trailing surface. During rotation of the spit cup about the cylindrical post, the leading surface engages the conical surface of the wing. Thereafter, counter-rotation of the spit cup about the cylindrical post is prevented by the trailing surface engaging the substantially flat surface of the wing.

A first expression of a second embodiment of the invention is for an inkjet printer spit cup assembly including an inkjet printer spit cup, an inkjet printer base portion, a cylindrical post, and a top tooth. The inkjet printer spit cup has an inner wall surface which surrounds a mounting hole and has a bottom surface which has bottom teeth positioned in an annular array. The inkjet printer base portion has a top surface. The cylindrical post is attached to the base portion, extends substantially vertically from the top surface, and is positioned in the mounting hole. The top tooth extends from the top surface and is located between two adjacent bottom teeth. The top tooth and the bottom teeth are adapted to permit rotation of the spit cup about the cylindrical post and to prevent counter-rotation of the spit cup about the cylindrical post.

A second expression of a second embodiment of the invention is for an inkjet printer spit cup assembly including in inkjet printer spit cup, an inkjet printer base portion, a cylindrical post, and a top tooth. The inkjet printer spit cup has a longitudinal axis, has an inner wall surface which surrounds a mounting hole substantially coaxially aligned with the longitudinal axis, and has a bottom surface which has bottom teeth positioned in an annular array substantially coaxially aligned with the longitudinal axis. The inkjet printer base portion has a top surface. The cylindrical post is attached to the base portion, extends substantially vertically from the top surface, and is positioned in the mounting hole. The top tooth extends from the top surface and is located between two adjacent bottom teeth. The top tooth and the bottom teeth are adapted to permit rotation of the spit cup about the cylindrical post and to prevent counter-rotation of the spit cup about the cylindrical post.

A third expression of a second embodiment of the invention is for an inkjet printer spit cup assembly including in inkjet printer spit cup, an inkjet printer base portion, a cylindrical post, and a top tooth. The inkjet printer spit cup has a longitudinal axis, has an inner wall surface which surrounds a mounting hole substantially coaxially aligned with the longitudinal axis, and has a bottom surface which has bottom teeth positioned in an annular array substantially coaxially aligned with the longitudinal axis. The inkjet printer base portion has a top surface. The cylindrical post is attached to the base portion, extends substantially vertically from the top surface, and is positioned in the mounting hole. The top tooth extends from the top surface, is located between two adjacent bottom teeth, and biases the spit cup to a position which is non-coaxial with the cylindrical post. The top tooth and the bottom teeth are adapted to permit rotation of the spit cup about the cylindrical post and to prevent counter-rotation of the spit cup about the cylindrical post.

Several benefits and advantages are derived from one or more of the expressions of two embodiments of the invention. In one application of the first embodiment, with parts made by rapid prototyping, having a wing on the cylindrical post and internal teeth on the spit cup engaging the wing allows rotation of the spit cup about the cylindrical post while preventing counter-rotation of the spit cup about the cylindrical post. Such wing of the cylindrical post and such internal teeth of the spit cup avoid the additional material and assembly cost of a back-stop spring. In one construction, the base portion, cylindrical post and wing, and the spit cup including internal teeth, can be two injection plastic molded parts which, in one implementation should provide biasing and compliance despite tolerances associated with injection plastic molding of parts, as can be appreciated by those skilled in the art. In one application of the second embodiment, having a top tooth on the base portion and bottom teeth on the spit cup engaging the top tooth should allow rotation of the spit cup about the cylindrical post while preventing counter-rotation of the spit cup about the cylindrical post. Such top tooth of the base portion and such bottom teeth of the spit cup would avoid the additional material and assembly cost of a back-stop spring. In one construction, the base portion, cylindrical post and top tooth, and the spit cup including bottom teeth, can be two injection plastic molded parts which, in one implementation should provide biasing and compliance despite tolerances associated with injection plastic molding of parts, as can be appreciated by those skilled in the art.

DETAILED DESCRIPTION

Figure 1:
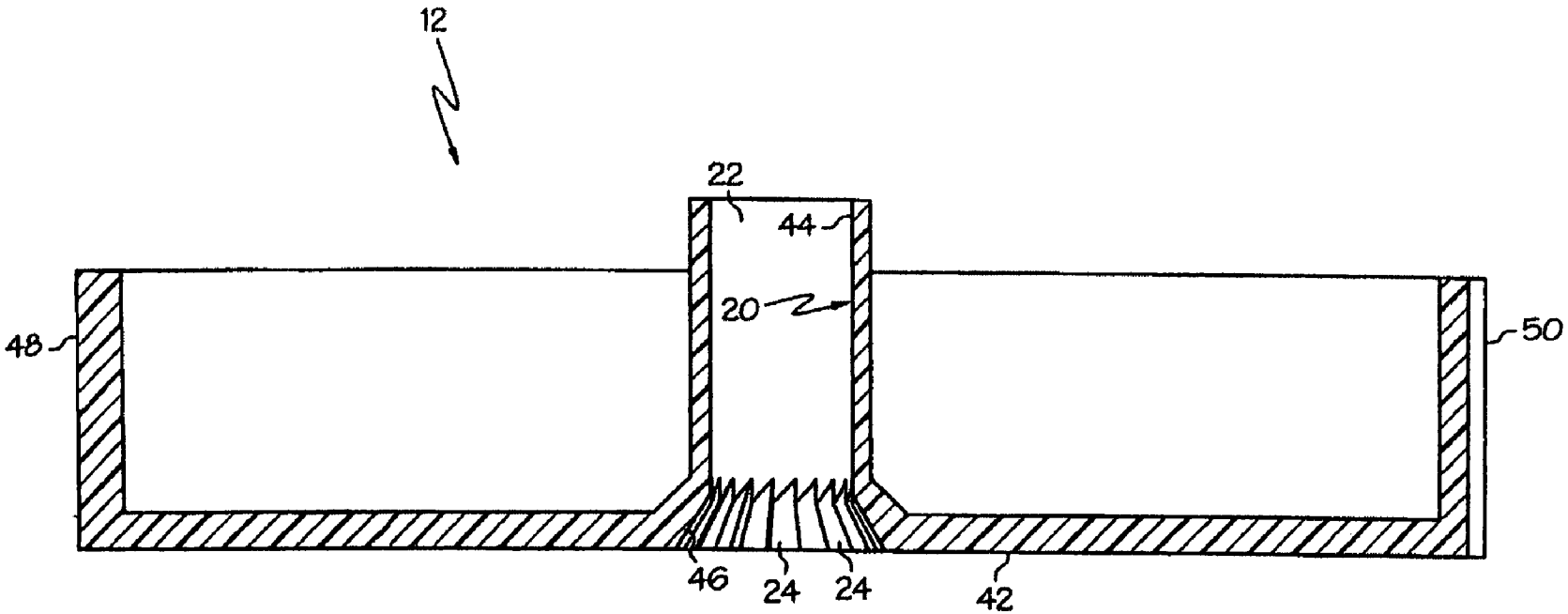
FIG. 1 is a cross sectional view of an embodiment of an inkjet printer spit cup of an inkjet printer spit cup assembly of the invention.
Figure 2:
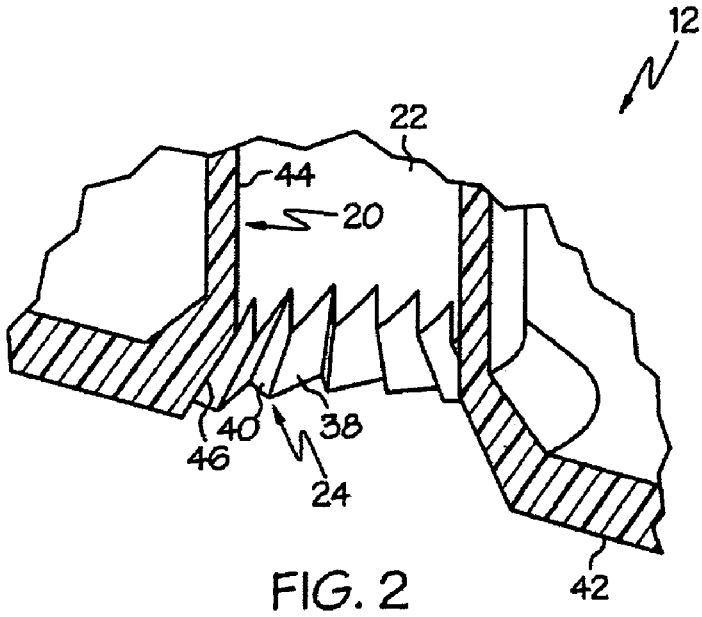
FIG. 2 is an enlarged cutaway view of a central lower portion of the spit cup of FIG. 1.
Figure 3:
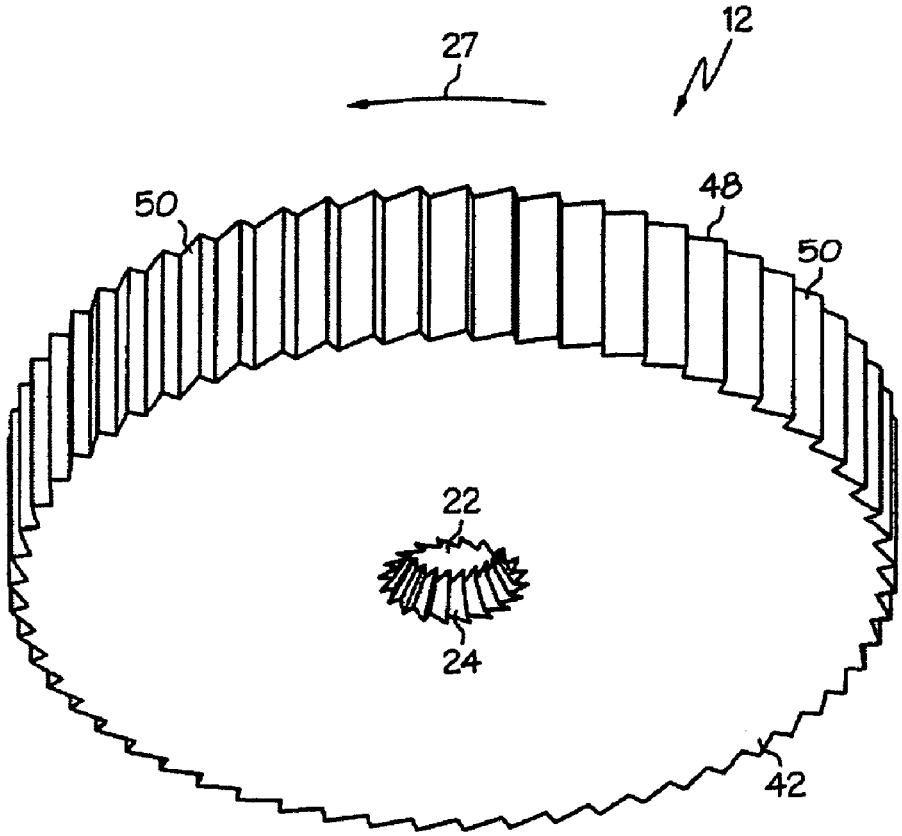
FIG. 3 is a bottom perspective view of the spit cup of FIG. 1.
Figure 4:
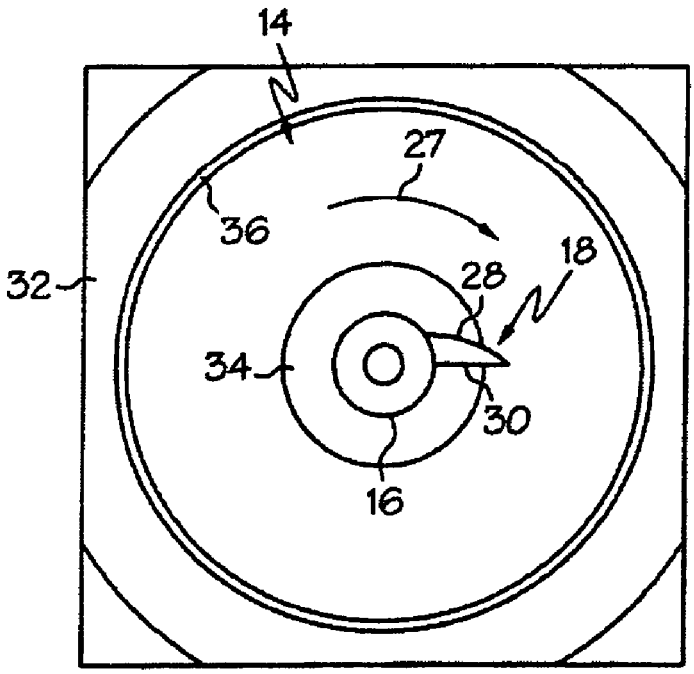
FIG. 4 is a top planar view of an embodiment of an inkjet printer base portion, an embodiment of a cylindrical post, and an embodiment of a wing of an inkjet printer spit cup assembly of the invention.
Figure 5:
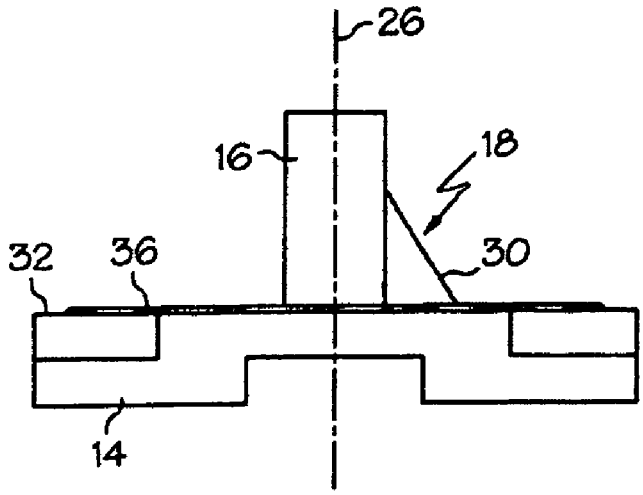
FIG. 5 is a side elevational view of the base portion, cylindrical post, and wing of FIG. 4.
Figure 6:
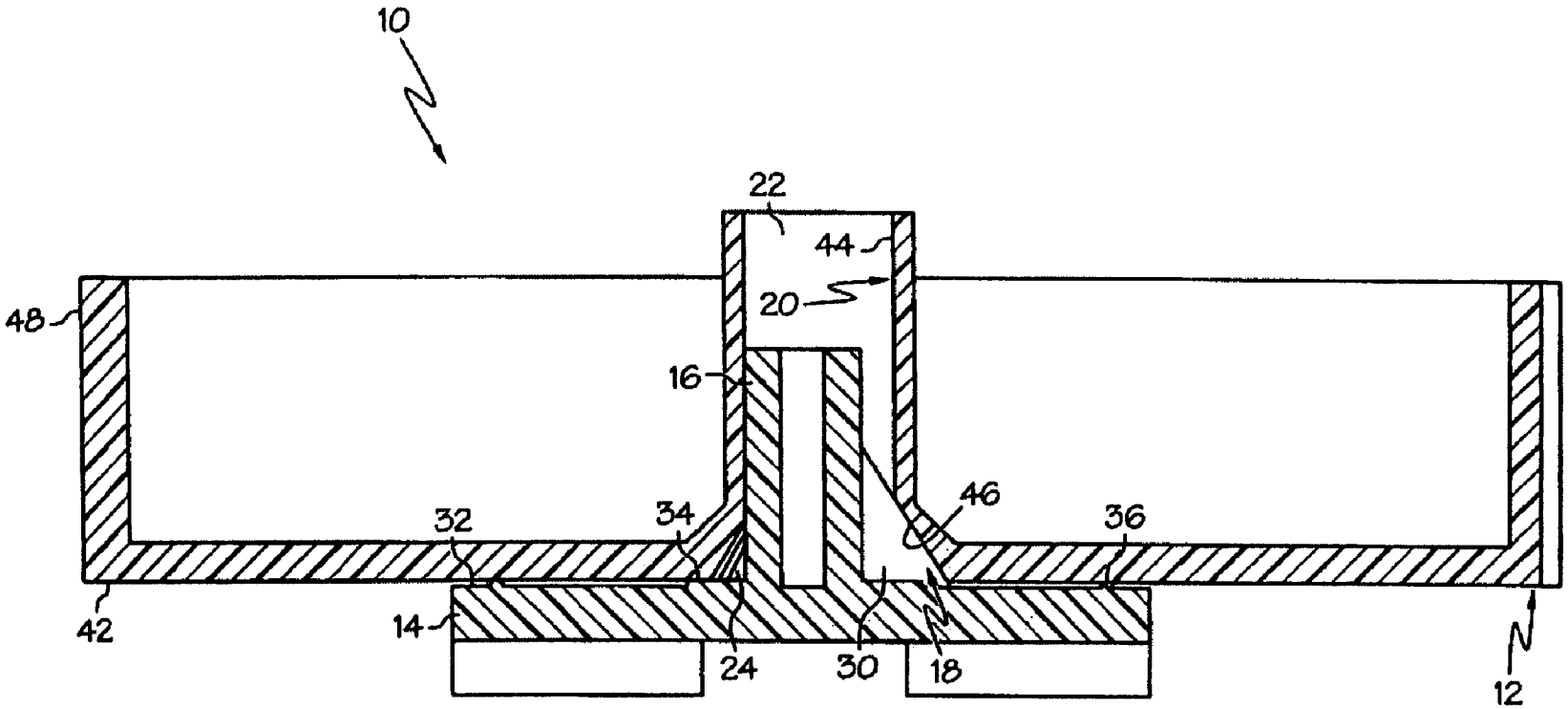
FIG. 6 is a cross sectional view of a first embodiment of an inkjet printer spit cup assembly of the invention showing the spit cup of FIG. 1 non-coaxially positioned on the cylindrical post of FIG. 5.
Figure 7:
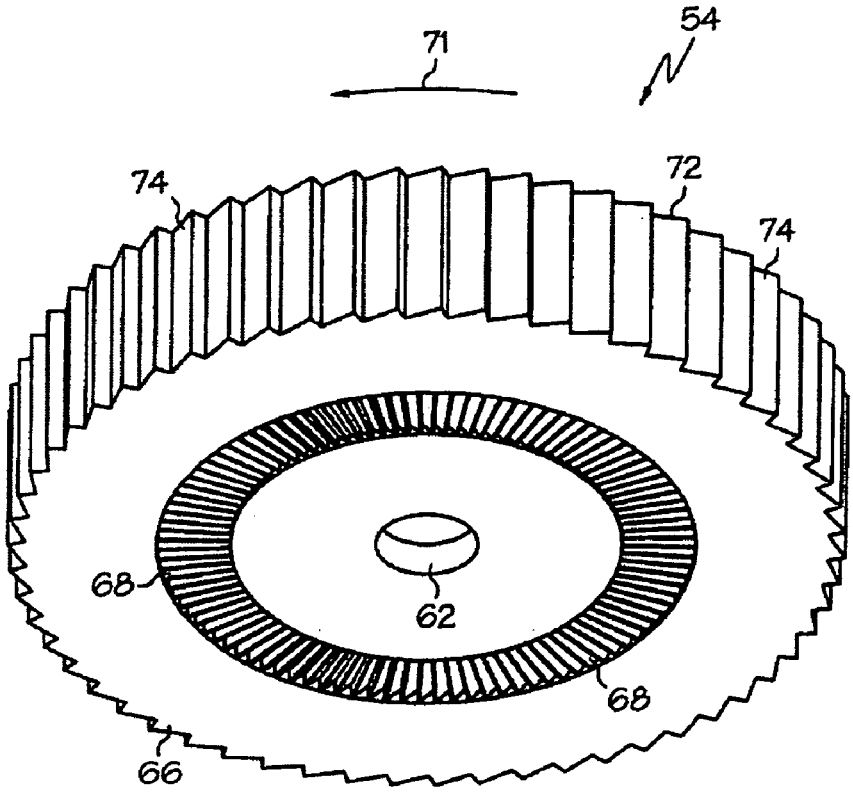
FIG. 7 is a bottom perspective view of an alternate embodiment of an inkjet printer spit cup of an inkjet printer spit cup assembly of the invention.
Figure 8:
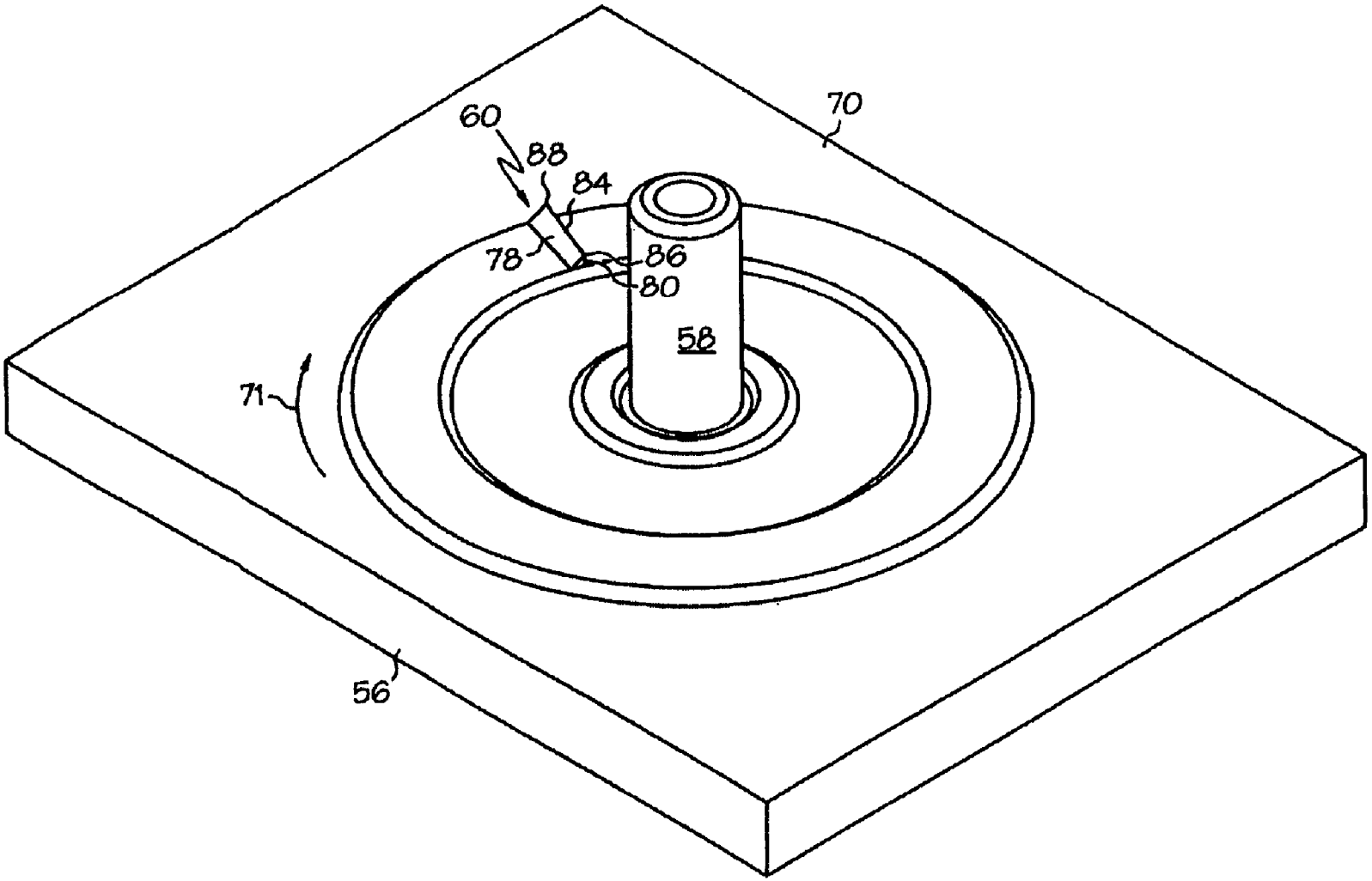
FIG. 8 is a top perspective view of an alternate embodiment of an inkjet printer base portion, an alternate embodiment of a cylindrical post, and an alternate embodiment of a top tooth of an inkjet printer spit cup assembly of the invention.
Figure 9:
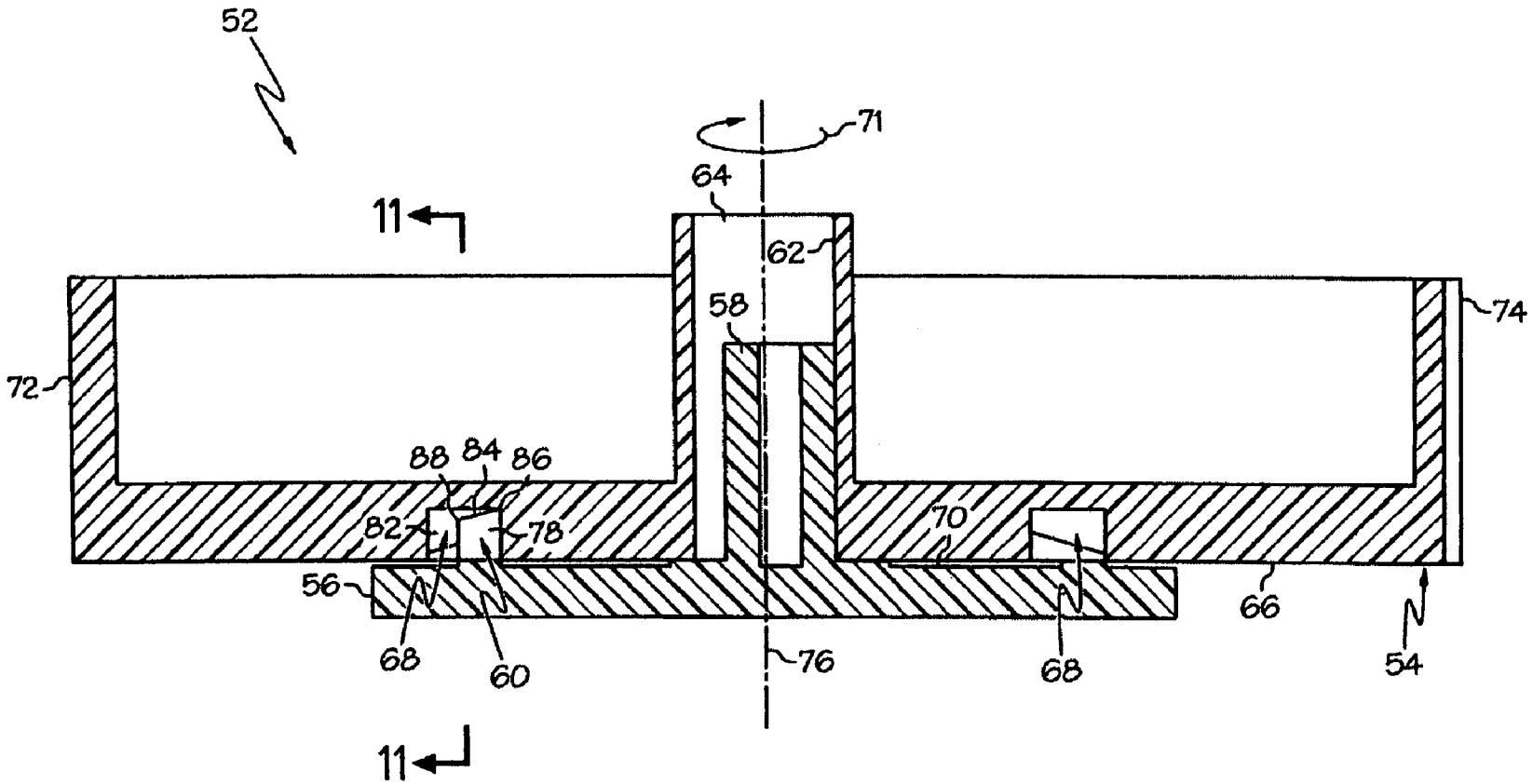
FIG. 9 is a cross sectional view of a second embodiment of an inkjet printer spit cup assembly of the invention showing the spit cut of FIG. 7 non-coaxially positioned on the cylindrical post of FIG. 8.

A first embodiment of an inkjet printer spit cup assembly 10 of the invention is shown in FIGS. 1–6. A first expression of the embodiment shown in FIGS. 1–6 is for an inkjet printer spit cup assembly 10 including an inkjet printer spit cup 12, an inkjet printer base portion 14, a cylindrical post 16, and a wing 18. The inkjet printer spit cup 12 has an inner wall surface 20 which surrounds a mounting hole 22 and which includes a plurality of inner teeth 24. The cylindrical post 16: has a longitudinal axis 26; is attached to, and extends substantially vertically from, the base portion 14; and is disposed in the mounting hole 22. The wing 18 is attached to at least one of the base portion 14 and the cylindrical post 16 and is disposed between two adjacent inner teeth 24. The wing 18 and the inner teeth 24 are adapted to permit rotation of the spit cup 12 about the cylindrical post 16 and to prevent counter-rotation of the spit cup 12 about the cylindrical post 16. It is noted that "rotation of the spit cup" means rotation of the spit cup 12 which includes rotation of an inner tooth 24 past the wing 18. The direction of rotation of the spit cup 12 of FIG. 3 when mounted on the cylindrical post 16 of FIG. 4 (such mounting shown in FIG. 6) is indicated by arrow 27 in FIGS. 3 and 4. It is further noted that "to prevent counter-rotation of the spit cup" is meant that counter-rotation of the spit cup 12 involving counter-rotation of an inner tooth 24 past the wing 18 is prevented.

In one example of the first expression of the embodiment of FIGS. 1–6, the wing 18 has a shape of substantially a one-quarter cone. In one variation, the wing 18 includes a substantially conical surface 28 and a substantially flat surface 30. In one modification, the substantially flat surface 30 lies substantially in a plane, wherein the longitudinal axis 26 lies in the plane. In this modification, a top planar view (as in FIG. 4) of the wing 18 and the cylindrical post 16 would show the substantially flat surface 30 as a line that would lie along a radius (not shown) extending from the center of the cylindrical post 16 as can be appreciated by the artisan. In one example, the base of the one-quarter cone is disposed proximate (the term "proximate" includes "on") the base portion 14, the axis (not shown) of the one-quarter cone is substantially parallel to the longitudinal axis 26 of the cylindrical post 16 and lies on the outer cylindrical surface of the cylindrical post 16, and the substantially conical surface 28 is aligned substantially forty-five degrees from the axis of the one-quarter cone. It is noted that the axis of the one-quarter cone is the axis running perpendicularly from the base to the apex of the cone (not shown) from which the one-quarter cone is a portion.

In one construction of the first expression of the embodiment of FIGS. 1–6, the wing 18 is attached to the cylindrical post 16 and the base portion 14. In one variation, the base portion 14, the cylindrical post 16, and the wing 18 are portions of a monolithic subassembly such as, without limitation, an injection molded plastic subassembly. In different variations, not shown, only two of the base portion 14, the cylindrical post 16 and the wing 18 are portions of a monolithic subassembly. In yet a different variation, not shown, none of the base portion 14, the cylindrical post 16 and the wing 18 are portions of a monolithic subassembly. In a different construction, not shown, the wing 18 is not attached to the cylindrical post 16. In yet a different construction, not shown, the wing 18 is not attached to the base portion 14.

In one illustration of the first expression of the embodiment of FIGS. 1–6, the base portion 14 includes a top surface 32. In one variation, the top surface 32 has a raised inner rub ring 34 proximate and surrounding the cylindrical post 16. In the same or another variation, the top surface 32 has a raised outer rub ring 36. The raised inner and/or outer rub rings 34 and/or 36 provide supporting raised bearing surfaces on which the spit cup 12 rotates while avoiding excess friction which would be present in the absence of such rub rings. In one design of the first expression of the embodiment of FIGS. 1–6, the mounting hole 22 of the spit cup 12 is a through hole. In a different design, the mounting hole is not a through hole.

In a first implementation of the first expression of the embodiment of FIGS. 1–6, each inner tooth 24 includes a leading surface 38 and a substantially flat trailing surface 40. During rotation of the spit cup 12 about the cylindrical post 16, the leading surface 38 engages the substantially conical surface 28 of the wing 18. Thereafter, counter-rotation of the spit cup 12 about the cylindrical post 16 is prevented by the substantially flat trailing surface 40 engaging the substantially flat surface 30 of the wing 18. In one variation the leading surface 38 of each inner tooth 24 is adapted wherein, during rotation of the spit cup 12 about the cylindrical post 16, each inner tooth 24 in turn moves up the substantially conical surface 28 of the wing 18 and down the substantially flat surface 30 of the wing 18. In one example, not shown, the spit cup 12 is rotated by engagement with a projection on a spring-biased maintenance sled moved by a printhead carrier entering a maintenance area, and the spit cup 12 is prevented from counter-rotation when the printhead carrier leaves the maintenance area and the maintenance sled returns to a start position.

In one enablement of the first expression of the embodiment of FIGS. 1–6, the spit cup 12 includes a bottom surface 42 which faces the base portion 14. In this enablement, the inner wall surface 20 includes a substantially constant diameter portion 44 and includes an outwardly flared portion 46 extending from the substantially constant diameter portion 44 to the bottom surface 42. In this enablement, the inner teeth 24 are disposed on the outwardly flared portion 46, and the cylindrical post 16 extends into the substantially constant diameter portion 44. In one example, the outwardly flared portion 46 of the inner wall surface 20 is aligned substantially forty-five degrees from the axis (not shown) of the substantially constant diameter portion 44 of the inner wall surface 20. In this example, the inner teeth 24 are beveled inner teeth. In one variation, the substantially flat trailing surface 40 of each inner tooth 24 lies substantially in a plane which wholly contains the axis of the substantially constant diameter portion 44 of the inner wall surface 20. In one modification, the leading surface 38 of each inner tooth 24 is a substantially flat leading surface, and a side elevational view (not shown) of an individual inner tooth 24 has the leading and trailing surfaces 38 and 40 as two lines meeting at substantially a forty-five degree angle.

In one application of the first expression of the embodiment of FIGS. 1–6, the spit cup 12 includes a raised outer rim 48 having outer teeth 50. In one variation, not shown, the spit cup 12 is rotated by having the outer teeth 50 be engaged with a projection on a spring-biased maintenance sled moved by a printhead carrier entering a maintenance area, and the spit cup 12 is prevented from counter-rotation, as previously described, when the printhead carrier leaves the maintenance area and the maintenance sled returns to a start position.

A second expression of the embodiment of FIGS. 1–6 is for an inkjet printer spit cup assembly 10 including an inkjet printer spit cup 12, an inkjet printer base portion 14, a cylindrical post 16, and a wing 18. The inkjet printer spit cup 12 has an inner wall surface 20 which surrounds a mounting hole 22 and which includes a plurality of inner teeth 24. The cylindrical post 16: has a longitudinal axis 26; is attached to, and extends substantially vertically from, the base portion 14; and is disposed in the mounting hole 22. The wing 18 is attached to at least one of the base portion 14 and the cylindrical post 16, is disposed between two adjacent inner teeth 24, and biases the spit cup 12 to a position which is non-coaxial with the cylindrical post 16. The wing 18 and the inner teeth 24 are adapted to permit rotation of the spit cup 12 about the cylindrical post 16 and to prevent counter-rotation of the spit cup 12 about the cylindrical post 16.

In one deployment of the second expression of the embodiment of FIGS. 1–6, such biasing is used to properly engage one of the outer teeth 50 of the outer rim 48 of the spit cup 12 with the projection of the maintenance sled (such maintenance sled and projection not shown). In one enablement of the second expression of the embodiment of FIGS. 1–6, the wing 18 includes a substantially conical surface 28 and a substantially flat surface 30, and the substantially conical surface 28 is in supporting contact with the inner wall surface 20 biasing the spit cup 12 to a position which is non-coaxial with the cylindrical post 16. In one variation, the diameter of the outer cylindrical surface of the cylindrical post 16 is smaller by a predetermined amount than the diameter of the substantially constant diameter portion 44 of the inner wall surface 20 to give the spit cup 12 enough play for optimal biasing operation of the spit cup 12 as can be appreciated by those skilled in the art. It is noted that the previously described examples, constructions, illustrations, etc. of the first expression of the embodiment of FIGS. 1–6 are equally applicable to the second expression of the embodiment of FIGS. 1–6.

A third expression of the embodiment of FIGS. 1–6 is for an inkjet printer spit cup assembly 10 including an inkjet printer spit cup 12, an inkjet printer base portion 14, a cylindrical post 16, and a wing 18. The inkjet printer spit cup 12 has an inner wall surface 20 which surrounds a mounting hole 22 and which includes a plurality of inner teeth 24. The cylindrical post 16: has a longitudinal axis 26; is attached to, and extends substantially vertically from, the base portion 14; and is disposed in the mounting hole 22. The wing 18 has a shape of substantially a one-quarter cone having a substantially conical surface 28 and a substantially flat surface 30. The wing 18 is attached to the base portion 14 and the cylindrical post 16 and is disposed between two adjacent inner teeth 24. The substantially conical surface 28 of the wing 18 is in supporting contact with at least one of the two adjacent inner teeth 24 of the inner wall surface 20 biasing the spit cup 12 to a position which is non-coaxial with the cylindrical post 16. Each inner tooth 24 includes a leading surface 38 and a substantially flat trailing surface 40. During rotation of the spit cup 12 about the cylindrical post 16, the leading surface 38 engages the substantially conical surface 28 of the wing 18. Thereafter, counter-rotation of the spit cup 12 about the cylindrical post 16 is prevented by the trailing surface 40 engaging the substantially flat surface 30 of the wing 18.

It is noted that the previously described examples, constructions, illustrations, deployments, enablements, etc. of the first and/or second expression of the embodiment of FIGS. 1–6 are equally applicable to the third expression of the embodiment of FIGS. 1–6.

In one configuration of one or more or all of the expressions of the embodiment of FIGS. 1–6, before rotation of the spit cup 12 is activated by, for example, a projection on a maintenance sled engaging an outer tooth 50 of the spit cup 12, the spit cup 12 has slid down under gravity to a first starting position where the wing 18 is disposed between two adjacent inner teeth 24 and where the spit cup 12 is biased by the wing 18 to contact the cylindrical post 16 opposite the wing 18. More particularly, the substantially conical surface 28 of the wing 18 is disposed rotationally against the leading surface 38 of the inner tooth 24 next to rotate past the wing 18, and the substantially flat surface 30 of the wing 18 is disposed rotationally against the substantially flat trailing surface 40 of the inner tooth 24 most recently rotated past the wing 18, preventing counter-rotation of the spit cup 12. As rotation of the spit cup 12 is begun, the wing 18 prevents pure rotational movement of the next inner tooth 24 past the wing 18, but the leading surface 38 of the next inner tooth 24 slides up the ever decreasing radius of the substantially conical surface 28 of the wing 18 during rotation of the spit cup 12 until the trailing edge 40 of the next inner tooth 24 can rotationally clear the substantially flat surface 30 of the wing 18. After this, the next inner tooth 24 falls down the substantially flat surface 30 of wing 18 to a next starting position whereupon the next inner tooth 24 becomes the inner tooth 24 most recently rotated past the wing 18.

A second embodiment of an inkjet printer spit cup assembly 52 of the invention is shown in FIGS. 7–11. A first expression of the embodiment shown in FIGS. 7–11 is for an inkjet printer spit cup assembly 52 including an inkjet printer spit cup 54, an inkjet printer base portion 56, a cylindrical post 58, and a top tooth 60. The inkjet printer spit cup 54 has an inner wall surface 62 which surrounds a mounting hole 64 and has a bottom surface 66 which has a plurality of bottom teeth 68 disposed in an annular array. The inkjet printer base portion 56 has a top surface 70. The cylindrical post 58 is attached to the base portion 56, extends substantially vertically from the top surface 70, and is disposed in the mounting hole 64. The top tooth 60 extends from the top surface 70 and is disposed between two adjacent bottom teeth 68. The top tooth 60 and the bottom teeth 68 are adapted to permit rotation of the spit cup 54 about the cylindrical post 58 and to prevent counter-rotation of the spit cup 54 about the cylindrical post 58. It is noted that "rotation of the spit cup" means rotation of the spit cup 54 which includes rotation of a bottom tooth 68 past the top tooth 60. The direction of rotation of the spit cup 54 of FIG. 7 when mounted on the cylindrical post 58 of FIG. 8 (such mounting shown in FIG. 9) is indicated by arrow 71 in FIGS. 7–10. It is further noted that "to prevent counter-rotation of the spit cup" is meant that counter-rotation of the spit cup 54 involving counter-rotation of a bottom tooth 68 past the top tooth 60 is prevented.

In one arrangement of the first expression of the embodiment of FIGS. 7–11, the spit cup 54 includes a raised outer rim 72 having outer teeth 74. In one construction of the first expression of the embodiment of FIGS. 7–11, the base portion 56, the cylindrical post 58, and the top tooth 60 are portions of a monolithic subassembly such as, without limitation, an injection molded plastic subassembly. In one example of the first expression of the embodiment of FIGS. 7–11, the top tooth 60 is substantially oriented 180 degrees from where the outer teeth 74 of the spit cup 54 are engaged by a projection on a spring-biased maintenance sled moved by a printhead carrier entering a maintenance area. Other arrangements, constructions, and examples are left to the artisan.

A second expression of the embodiment shown in FIGS. 7–11 is for an inkjet printer spit cup assembly 52 including an inkjet printer spit cup 54, an inkjet printer base portion 56, a cylindrical post 58, and a top tooth 60. The inkjet printer spit cup 54 has a longitudinal axis 76, has an inner wall surface 62 which surrounds a mounting hole 64 substantially coaxially aligned with the longitudinal axis 76, and has a bottom surface 66 which has a plurality of bottom teeth 68 disposed in an annular array substantially coaxially aligned with the longitudinal axis 76. The inkjet printer base portion 56 has a top surface 70. The cylindrical post 58 is attached to the base portion 56, extends substantially vertically from the top surface 70, and is disposed in the mounting hole 64. The top tooth 60 extends from the top surface 70 and is disposed between two adjacent bottom teeth 68. The top tooth 60 and the bottom teeth 68 are adapted to permit rotation of the spit cup 54 about the cylindrical post 58 and to prevent counter-rotation of the spit cup 54 about the cylindrical post 58.

Figure 10:
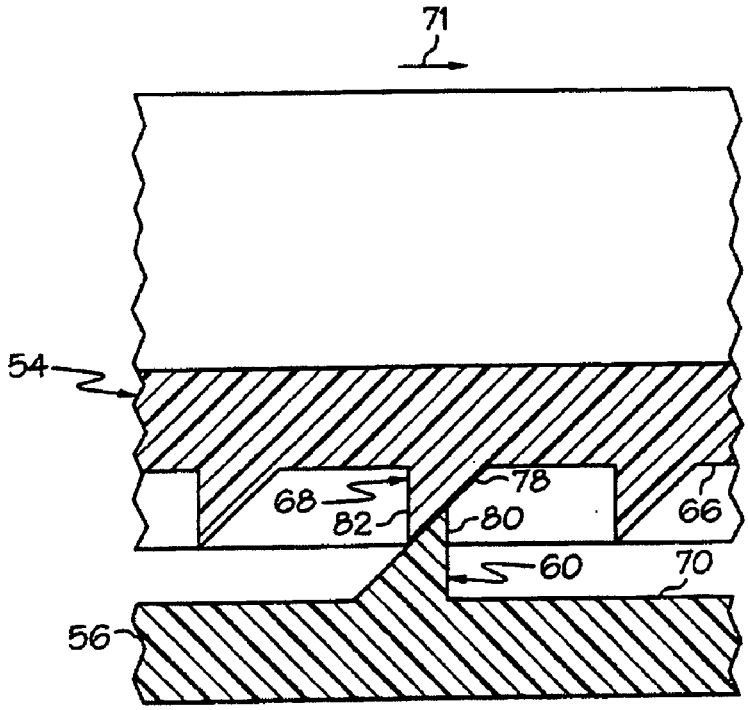
FIG. 10 is an enlarged cross sectional view, looking radially outward, of a portion of the spit cup and base portion of FIG. 9, showing a bottom tooth of the spit cup being rotated over the top tooth of the base portion, wherein some bottom teeth of the spit cup have been omitted for clarity.
Figure 11:
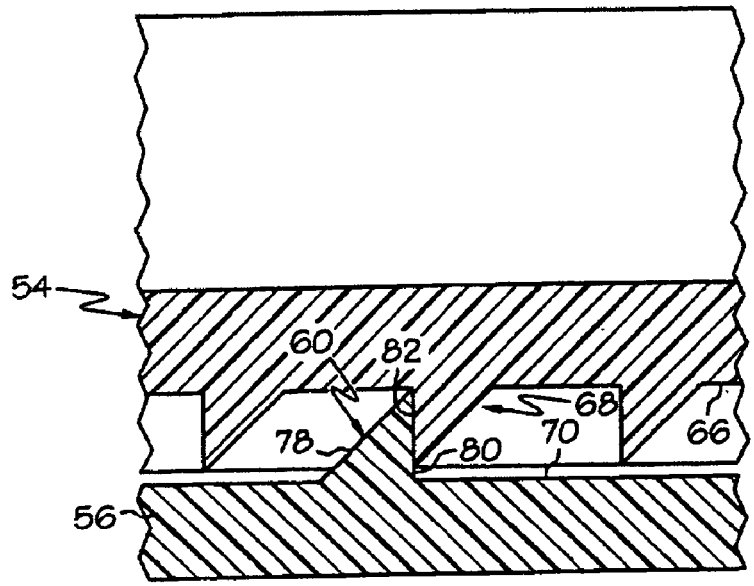
FIG. 11 is an enlarged cross sectional view, as in FIG. 10, but taken along arrows 11—11 of FIG. 9 and showing that bottom tooth having moved past the top tooth and having moved down the substantially vertical surface of the top tooth with counter-rotation being prevented by the substantially vertical surface of that bottom tooth engaging the substantially vertical surface of the top tooth.

In one application of the second expression of the embodiment of FIGS. 7–11, the bottom teeth 68 are recessed bottom teeth. In one implementation of the second expression of the embodiment of FIGS. 7–11, the top tooth 60 is radially spaced apart from the cylindrical post 58. In one employment of the second expression of the embodiment of FIGS. 7–11, the top tooth 60 includes an inclined surface 78 and a substantially vertical surface 80, and each bottom tooth 68 includes a substantially vertical surface 82. In this employment, during rotation of the spit cup 54 about the cylindrical post 58, each bottom tooth 68 in turn moves up the inclined surface 78 of the top tooth 60 (as seen in FIG. 10 wherein the spit cup 54 is rotating in the direction of arrow 71) and down the substantially vertical surface 80 of the top tooth 60 (as seen in FIG. 11), and, thereafter, counter-rotation of the spit cup 54 about the cylindrical post 58 is prevented by the substantially vertical surface 82 of the just-moved-up-and-down bottom tooth 68 engaging the substantially vertical surface 80 of the top tooth 60. In one arrangement of the first expression of the embodiment of FIGS. 7–11, the spit cup 54 includes a raised outer rim 72 having outer teeth 74.

It is noted that the arrangements, constructions, examples etc. of the first expression of the embodiment of FIGS. 7–11 are equally applicable to the second expression of the embodiment of FIGS. 7–11.

A third expression of the embodiment shown in FIGS. 7–11 is for an inkjet printer spit cup assembly 52 including an inkjet printer spit cup 54, an inkjet printer base portion 56, a cylindrical post 58, and a top tooth 60. The inkjet printer spit cup 54 has a longitudinal axis 76, has an inner wall surface 62 which surrounds a mounting hole 64 substantially coaxially aligned with the longitudinal axis 76, and has a bottom surface 66 which has a plurality of bottom teeth 68 disposed in an annular array substantially coaxially aligned with the longitudinal axis 76. The inkjet printer base portion 56 has a top surface 70. The cylindrical post 58 is attached to the base portion 56, extends substantially vertically from the top surface 70, and is disposed in the mounting hole 64. The top tooth 60 extends from the top surface 70, is disposed between two adjacent bottom teeth 68, and biases the spit cup 54 to a position which is non-coaxial with the cylindrical post 58. The top tooth 60 and the bottom teeth 68 are adapted to permit rotation of the spit cup 54 about the cylindrical post 58 and to prevent counter-rotation of the spit cup 54 about the cylindrical post 58.

In one enablement of the third expression of the embodiment of FIGS. 7–11, each bottom tooth 68 is radially wider than the top tooth 60. In one deployment of the third expression of the embodiment of FIGS. 7–11, the top tooth 60 includes an inclined surface 78 and a substantially vertical surface 80 joined together at an edge 84, and the inclined surface 78 is substantially planar. In this deployment, the edge 84 has a radially-inner corner 86 and a radially-outer corner 88, wherein the inclined surface 78 is tilted with respect to the top surface 70 with the radially-outer corner 88 of the edge 84 higher than the radially-inner corner 86 of the edge 84, and the inclined surface 78 is in supporting contact with the bottom surface 66 biasing the spit cup 54 to a position which is non-coaxial with the cylindrical post 58. Alternatively, the outer corner 88 can be lower than the inner corner 86. The direction and amount that the top tooth 60 is tilted is used to determine the direction and amount of bias applied to the spit cup. In one variation, the bottom teeth 68 are correspondingly tilted. In one modification, not shown, the substantially vertical surface 80 of the top tooth 60 is shorter than the substantially vertical surface 82 of each bottom tooth 68.

It is noted that the arrangements, constructions, examples etc. of the first expression of the embodiment of FIGS. 7–11 are equally applicable to the third expression of the embodiment of FIGS. 7–11. It is also noted that the applications, implementations, employments, arrangements, etc. of the second expression of the embodiment of FIGS. 7–11 are equally applicable to the third expression of the embodiment of FIGS. 7–11.

Several benefits and advantages are derived from one or more of the expressions of two embodiments of the invention. In one application of the first embodiment, with parts made by rapid prototyping, having a wing on the cylindrical post and internal teeth on the spit cup engaging the wing allows rotation of the spit cup about the cylindrical post while preventing counter-rotation of the spit cup about the cylindrical post. Such wing of the cylindrical post and such internal teeth of the spit cup avoid the additional material and assembly cost of a back-stop spring. In one construction, the base portion, cylindrical post and wing, and the spit cup including internal teeth, can be two injection plastic molded parts which, in one implementation should provide biasing and compliance despite tolerances associated with injection plastic molding of parts, as can be appreciated by those skilled in the art. In one application of the second embodiment, having a top tooth on the base portion and bottom teeth on the spit cup engaging the top tooth should allow rotation of the spit cup about the cylindrical post while preventing counter-rotation of the spit cup about the cylindrical post. Such top tooth of the base portion and such bottom teeth of the spit cup would avoid the additional material and assembly cost of a back-stop spring. In one construction, the base portion, cylindrical post and top tooth, and the spit cup including bottom teeth, can be two injection plastic molded parts which, in one implementation should provide biasing and compliance despite tolerances associated with injection plastic molding of parts, as can be appreciated by those skilled in the art.

The foregoing description of several expressions of two embodiments of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

What is claimed is:

1. An inkjet printer spit cup assembly comprising:

a) an inkjet printer spit cup having an inner wall surface which surrounds a mounting hole and which includes a plurality of inner teeth;

b) an inkjet printer base portion;

c) a cylindrical post which has a longitudinal axis, which is attached to, and extends substantially vertically from, the base portion, and which is disposed in the mounting hole; and d) a wing which is attached to at least one of the base portion and the cylindrical post and which is disposed between two adjacent inner teeth, wherein the wing and the inner teeth are adapted to permit rotation of the spit cup about the cylindrical post and to prevent counter-rotation of the spit cup about the cylindrical post.

2. The inkjet printer spit cup assembly of claim 1, wherein the wing has a shape of substantially a one-quarter cone.

3. The inkjet printer spit cup assembly of claim 2, wherein the wing includes a substantially conical surface and a substantially flat surface.

4. The inkjet printer spit cup assembly of claim 3, wherein the substantially flat surface lies substantially in a plane, and wherein the longitudinal axis lies in the plane.

5. The inkjet printer spit cup assembly of claim 4, wherein the wing is attached to one of the cylindrical post, the base portion, and both the cylindrical post and base portion.

6. The inkjet printer spit cup assembly of claim 4, wherein each inner tooth includes a leading surface and a substantially flat trailing surface, wherein, during rotation of the spit cup about the cylindrical post, the leading surface engages the substantially conical surface of the wing, and wherein, thereafter, counter-rotation of the spit cup about the cylindrical post is prevented by the trailing surface engaging the substantially flat surface of the wing.

7. The inkjet printer spit cup assembly of claim 6, wherein the leading surface of each inner tooth is adapted wherein, during rotation of the spit cup about the cylindrical post, each inner tooth in turn moves up the substantially conical surface of the wing and down the substantially flat surface of the wing.

8. The inkjet printer spit cup assembly of claim 7, wherein the spit cup includes a bottom surface which faces the base portion, wherein the inner wall surface includes a substantially constant diameter portion and includes an outwardly flared portion extending from the substantially constant diameter portion to the bottom surface, wherein the inner teeth are disposed on the outwardly flared portion, and wherein the cylindrical post extends into the substantially constant diameter portion.

9. The inkjet printer spit cup assembly of claim 8, wherein the spit cup includes a raised outer rim having outer teeth.

10. An inkjet printer spit cup assembly comprising:

a) an inkjet printer spit cup having an inner wall surface which surrounds a mounting hole and which includes a plurality of inner teeth;

b) an inkjet printer base portion;

c) a cylindrical post which has a longitudinal axis, which is attached to, and extends substantially vertically from, the base portion, and which is disposed in the mounting hole; and d) a wing which is attached to at least one of the base portion and the cylindrical post, which is disposed between two adjacent inner teeth, and which biases the spit cup to a position which is non-coaxial with the cylindrical post, wherein the wing and the inner teeth are adapted to permit rotation of the spit cup about the cylindrical post and to prevent counter-rotation of the spit cup about the cylindrical post.

11. The inkjet printer spit cup assembly of claim 10, wherein the wing has a shape of substantially a one-quarter cone.

12. The inkjet printer spit cup assembly of claim 11, wherein the wing includes a substantially conical surface and a substantially flat surface, and wherein the substantially conical surface is in supporting contact with the inner wall surface biasing the spit cup to a position which is non-coaxial with the cylindrical post.

13. The inkjet printer spit cup assembly of claim 12, wherein the substantially flat surface lies substantially in a plane, and wherein the longitudinal axis lies in the plane.

14. The inkjet printer spit cup assembly of claim 13, wherein the wing is attached to the cylindrical post and the base portion.

15. The inkjet printer spit cup assembly of claim 13, wherein each inner tooth includes a leading surface and a substantially flat trailing surface, wherein, during rotation of the spit cup about the cylindrical post, the leading surface engages the substantially conical surface of the wing, and wherein, thereafter, counter-rotation of the spit cup about the cylindrical post is prevented by the trailing surface engaging the substantially flat surface of the wing.

16. The inkjet printer spit cup assembly of claim 15, wherein the leading surface of each inner tooth is adapted wherein, during rotation of the spit cup about the cylindrical post, each inner tooth in turn moves up the substantially conical surface of the wing and down the substantially flat surface of the wing.

17. The inkjet printer spit cup assembly of claim 16, wherein the spit cup includes a bottom surface which faces the base portion, wherein the inner wall surface includes a substantially constant diameter portion and includes an outwardly flared portion extending from the substantially constant diameter portion to the bottom surface, wherein the inner teeth are disposed on the outwardly flared portion, and wherein the cylindrical post extends into the substantially constant diameter portion.

18. The inkjet printer spit cup assembly of claim 17, wherein the spit cup includes a raised outer rim having outer teeth.

19. An inkjet printer spit cup assembly comprising:

a) an inkjet printer spit cup having an inner wall surface which surrounds a mounting hole and which includes a plurality of inner teeth;

b) an inkjet printer base portion;

c) a cylindrical post which has a longitudinal axis, which is attached to, and extends substantially vertically from, the base portion, and which is disposed in the mounting hole; and d) a wing which has a shape of substantially a one-quarter cone having a substantially conical surface and a substantially flat surface, which is attached to the base portion and the cylindrical post, and which is disposed between two adjacent inner teeth, wherein the substantially conical surface of the wing is in supporting contact with at least one of the two adjacent inner teeth of the inner wall surface biasing the spit cup to a position which is non-coaxial with the cylindrical post, wherein each inner tooth includes a leading surface and a substantially flat trailing surface, wherein, during rotation of the spit cup about the cylindrical post, the leading surface engages the substantially conical surface of the wing, and wherein, thereafter, counter-rotation of the spit cup about the cylindrical post is prevented by the trailing surface engaging the substantially flat surface of the wing.

20. The inkjet printer spit cup assembly of claim 19, wherein the leading surface of each inner tooth is adapted wherein, during rotation of the spit cup about the cylindrical post, each inner tooth in turn moves up the substantially conical surface of the wing and down the substantially flat surface of the wing.

21. An inkjet printer spit cup assembly comprising:

a) an inkjet printer spit cup having an inner wall surface which surrounds a mounting hole and having a bottom surface which has a plurality of bottom teeth disposed in an annular array;

b) an inkjet printer base portion having a top surface;

c) a cylindrical post which is attached to the base portion, which extends substantially vertically from the top surface, and which is disposed in the mounting hole; and d) a top tooth which extends from the top surface and which is disposed between two adjacent bottom teeth, wherein the top tooth and the bottom teeth are adapted to permit rotation of the spit cup about the cylindrical post and to prevent counter-rotation of the spit cup about the cylindrical post.

22. The inkjet printer spit cup assembly of claim 21, wherein the spit cup includes a raised outer rim having outer teeth.

23. An inkjet printer spit cup assembly comprising:

a) an inkjet printer spit cup having a longitudinal axis, having an inner wall surface which surrounds a mounting hole substantially coaxially aligned with the longitudinal axis, and having a bottom surface which has a plurality of bottom teeth disposed in an annular array substantially coaxially aligned with the longitudinal axis;

b) an inkjet printer base portion having a top surface;

c) a cylindrical post which is attached to the base portion, which extends substantially vertically from the top surface, and which is disposed in the mounting hole; and d) a top tooth which extends from the top surface and which is disposed between two adjacent bottom teeth, wherein the top tooth and the bottom teeth are adapted to permit rotation of the spit cup about the cylindrical post and to prevent counter-rotation of the spit cup about the cylindrical post.

24. The inkjet printer spit cup assembly of claim 23, wherein the bottom teeth are recessed bottom teeth.

25. The inkjet printer spit cup assembly of claim 24, wherein the top tooth is radially spaced apart from the cylindrical post.

26. The inkjet printer spit cup assembly of claim 25, wherein the top tooth includes an inclined surface and a substantially vertical surface, wherein each bottom tooth includes a substantially vertical surface, wherein, during rotation of the spit cup about the cylindrical post, each bottom tooth in turn moves up the inclined surface of the top tooth and down the substantially vertical surface of the top tooth, and wherein, thereafter, counter-rotation of the spit cup about the cylindrical post is prevented by the substantially vertical surface of the just-moved-up-and-down bottom tooth engaging the substantially vertical surface of the top tooth.

27. The inkjet printer spit cup assembly of claim 26, wherein the spit cup includes a raised outer rim having outer teeth.

28. The inkjet printer spit cup assembly of claim 23, wherein the top tooth is radially spaced apart from the cylindrical post.

29. The inkjet printer spit cup assembly of claim 23, wherein the top tooth includes an inclined surface and a substantially vertical surface, wherein each bottom tooth includes a substantially vertical surface, wherein, during rotation of the spit cup about the cylindrical post, each bottom tooth in turn moves up the inclined surface of the top tooth and down the substantially vertical surface of the top tooth, and wherein, thereafter, counter-rotation of the spit cup about the cylindrical post is prevented by the substantially vertical surface of the just-moved-up-and-down bottom tooth engaging the substantially vertical surface of the top tooth.

30. The inkjet printer spit cup assembly of claim 23, wherein the spit cup includes a raised outer rim having outer teeth.

31. An inkjet printer spit cup assembly comprising:

a) an inkjet printer spit cup having a longitudinal axis, having an inner wall surface which surrounds a mounting hole substantially coaxially aligned with the longitudinal axis, and having a bottom surface which has a plurality of bottom teeth disposed in an annular array substantially coaxially aligned with the longitudinal axis;

b) an inkjet printer base portion having a top surface;

c) a cylindrical post which is attached to the base portion, which extends substantially vertically from the top surface, and which is disposed in the mounting hole; and d) a top tooth which extends from the top surface, which is disposed between two adjacent bottom teeth, and which biases the spit cup to a position which is non-coaxial with the cylindrical post, and wherein the top tooth and the bottom teeth are adapted to permit rotation of the spit cup about the cylindrical post and to prevent counter-rotation of the spit cup about the cylindrical post.

32. The spit cup assembly of claim 31, wherein each bottom tooth is radially wider than the top tooth.

33. The spit cup assembly of claim 32, wherein the top tooth includes an inclined surface and a substantially vertical surface joined together at an edge, wherein the inclined surface is substantially planar, wherein the edge has a radially-inner corner and a radially-outer corner, and wherein the inclined surface is tilted with respect to the top surface with the radially-outer corner of the edge being of a different height than the radially-inner corner of the edge.

34. The inkjet printer spit cup assembly of claim 33, wherein the radially-outer corner of the edge is lower than the radially-inner corner of the edge.

35. The inkjet printer spit cup assembly of claim 31, wherein the radially-outer corner of the edge is higher than the radially-inner corner of the edge.

36. The inkjet printer spit cup assembly of claim 31, wherein the inner teeth are recessed bottom teeth.

37. The inkjet printer spit cup assembly of claim 36, wherein the top tooth is radially spaced apart from the cylindrical post.

38. The inkjet printer spit cup assembly of claim 37, wherein the top tooth includes an inclined surface and a substantially vertical surface, wherein each bottom tooth includes a substantially vertical surface, wherein, during rotation of the spit cup about the cylindrical post, each bottom tooth in turn moves up the inclined surface of the top tooth and down the substantially vertical surface of the top tooth, and wherein, thereafter, counter-rotation of the spit cup about the cylindrical post is prevented by the substantially vertical surface of the just-moved-up-and-down bottom tooth engaging the substantially vertical surface of the top tooth.

39. The inkjet printer spit cup assembly of claim 38, wherein the spit cup includes a raised outer rim having outer teeth.

40. The inkjet printer spit cup assembly of claim 31, wherein the top tooth is radially spaced apart from the cylindrical post.

41. The inkjet printer spit cup assembly of claim 31, wherein the top tooth includes an inclined surface and a substantially vertical surface, wherein each bottom tooth includes a substantially vertical surface, wherein, during rotation of the spit cup about the cylindrical post, each bottom tooth in turn moves up the inclined surface of the top tooth and down the substantially vertical surface of the top tooth, and wherein, thereafter, counter-rotation of the spit cup about the cylindrical post is prevented by the substantially vertical surface of the just-moved-up-and-down bottom tooth engaging the substantially vertical surface of the top tooth.

42. The inkjet printer spit cup assembly of claim 31, wherein the spit cup includes a raised outer rim having outer teeth.

* * * * *